US007747180B2

(12) United States Patent
Wittenauer et al.

(10) Patent No.: US 7,747,180 B2
(45) Date of Patent: Jun. 29, 2010

(54) METHODS AND APPARATUSES FOR DETERMINING THE NUMBER OF PRINTED PAGES REMAINING IN A TONER CARTRIDGE

(75) Inventors: Joel P. Wittenauer, Shelbyville, KY (US); William K. Richardson, Salvisa, KY (US); James A. Carter, II, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 462 days.

(21) Appl. No.: 11/807,898

(22) Filed: May 30, 2007

(65) Prior Publication Data

US 2008/0298823 A1 Dec. 4, 2008

(51) Int. Cl.
*G03G 15/08* (2006.01)

(52) U.S. Cl. ..... 399/27; 399/61

(58) Field of Classification Search ..... 399/27, 399/61, 30, 53

See application file for complete search history.

(56) References Cited

U.S. PATENT DOCUMENTS 5,489,971 A 2/1996 Nam
5,802,420 A * 9/1998 Garr et al. ..... 399/27
6,275,664 B1 * 8/2001 Wolf et al. ..... 399/27
6,584,291 B1 * 6/2003 Yamamoto ..... 399/27
6,609,461 B2 * 8/2003 Horii et al.
6,810,218 B1 * 10/2004 Wong et al. ..... 399/27
6,863,364 B2 3/2005 Russell et al.
7,079,794 B2 * 7/2006 Forbes et al. ..... 399/27
7,088,929 B2 * 8/2006 Ahn ..... 399/27
7,302,198 B2 * 11/2007 Ahn ..... 399/27
2002/0141765 A1 * 10/2002 Phillips ..... 399/27
2004/0228642 A1 * 11/2004 Iida et al. ..... 399/27
2005/0135819 A1 * 6/2005 Ahn ..... 399/27
2005/0147422 A1 * 7/2005 Ahn ..... 399/27
2005/0163514 A1 * 7/2005 Hwang ..... 399/27
2006/0098995 A1 * 5/2006 Kim et al. ..... 399/27

FOREIGN PATENT DOCUMENTS

JP 2002328568 A * 11/2002
JP 2005100229 A * 4/2005
JP 2006065125 A * 3/2006
JP 2006251180 A * 9/2006
JP 2006308854 A * 11/2006

* cited by examiner

*Primary Examiner*—Susan S Lee
(74) *Attorney, Agent, or Firm*—Michael T. Sanderson; John Victor Pezdek

(57) ABSTRACT

A method for determining the number of printed pages remaining in a toner cartridge for an electrophotographic image forming device. A toner cartridge and electrophotographic image forming device for storing and/or performing aspects of the method is also provided.

25 Claims, 5 Drawing Sheets

METHODS AND APPARATUSES FOR DETERMINING THE NUMBER OF PRINTED PAGES REMAINING IN A TONER CARTRIDGE

FIELD OF THE INVENTION

The present invention generally relates to the field of electrophotographic image forming devices ("EP devices"). More specifically, it relates to a method for determining the number of printed pages remaining in a removable toner cartridge for an EP device. A toner cartridge and/or EP device capable of storing and/or performing aspects of the method is also contemplated.

BACKGROUND OF THE INVENTION

Electrophotographic image forming devices ("EP devices"), such as photocopiers, laser printers, and facsimile machines, may employ the use of a removable toner cartridge assembly containing a fixed supply of toner. As pages become printed, this toner supply decreases. At some point the toner supply becomes so depleted that the quality of the printed pages deteriorates and the cartridge must be replaced. Often times, the onset of the low toner supply comes suddenly. This may present a suboptimal situation for a user who does not have a replacement cartridge at hand. Namely, the user will not be able to resume printing high-quality printed pages until he or she obtains a replacement cartridge. This may result in a period of downtime when the printer is substantially unusable.

Additionally, manufacturers desire methods for estimating the number of printed pages remaining on a given toner cartridge. For instance, when establishing a default supply yield or yield range for a given model of cartridge during testing, manufacturers require accurate methods for estimating the total number of printed pages remaining on a toner cartridge.

To address these issues, several methods have been contemplated for estimating the total number of printed pages that can be produced with a toner cartridge or are remaining on a given toner cartridge. One method simply counts the pages printed and compares this amount to a predetermined value. If the number of pages printed exceeds the predetermined value, a message may be generated informing a user to replace the toner cartridge. Instead of using a predetermined value, other methods compare the number of pages printed with a fixed, estimated amount of toner used per page. Unfortunately, these methods cannot adapt for the specific type of printing being conducted by the user. For instance, a user that prints mostly text documents may use less toner than a user printing complex graphical images. Accordingly, these static methods often produce spurious results that provide incorrect information on the remaining life of a toner cartridge. Also, these methods rely on an actual page count of the number of pages printed, which may also contribute to suboptimal results.

Accordingly, the need exists for a method for determining the number of printed pages remaining in a removable toner cartridge for an EP device. The method would not depend on the actual number of pages printed, but would take into account other variables, including the amount of toner used per individual page. Also, the need exists for a toner cartridge and/or EP device capable of storing and/or performing such a method.

SUMMARY OF THE INVENTION

In accordance with one aspect of the invention, a method for determining a number of pages remaining in a toner cartridge having an initial load of toner is disclosed. The method may include estimating an average mass of toner used per printed page for all pages printed with the toner cartridge. This estimating may use an averaging function tied to a mass of toner used for a current printed page and a decrease in an amount of toner from the initial load of toner. The method may also include estimating a number of total pages printed with the toner cartridge based on the decrease in the amount of toner from the initial load of toner. Also, the method may include calculating an actual average mass of toner used per printed page for all pages printed with the toner cartridge based on the decrease in the amount of toner from the initial load of toner. The method may also include determining the number of pages remaining in the toner cartridge based on the actual average mass of toner used per printed page for all pages printed with the toner cartridge.

In one embodiment the method includes the step of calculating the decrease in the amount of toner from the initial load of toner. This calculating may comprise setting the total amount of toner used to a default value. This calculating a total amount of toner used may include increasing the default value by the mass of toner used for the current printed page.

The method may also include the step of calculating an amount of toner remaining in the toner cartridge. The calculating the amount of toner remaining in the toner cartridge may include measuring the amount of toner remaining in the toner cartridge with a sensor. The method may also include the step of calculating the decrease in the amount of toner from the initial load of toner.

In accordance with a second aspect of the invention, a method for analyzing a toner cartridge is disclosed. The method may include calculating an average mass of toner used per printed page for all pages printed with the toner cartridge, the calculating using an averaging function. The method may also include estimating a number of pages printed with the toner cartridge based on the average mass of toner used and a decrease in an amount of toner from an initial supply of toner. Also, the method may include calculating an actual average mass of toner used per printed page using the estimated number of pages printed. The method may also include calculating the number of printed pages remaining in the toner cartridge based on the actual average mass of toner used per printed page.

In one embodiment, the averaging function is tied to a mass of toner used for a current printed page and the decrease in an amount of toner from the initial load of toner. The mass of toner used for the current printed page may be calculated using a pel count algorithm. In one embodiment, the estimating the number of pages printed comprises dividing the decrease in an amount of toner from the initial load of toner by the calculated average mass of toner used per printed page for all pages printed with the toner cartridge. The method may also include the step of adjusting the value of the decrease in the amount of toner from the initial load of toner based on a measurement of the amount of toner remaining in the toner cartridge, thereby obtaining a resolved mass of toner used. The calculating an actual average mass of toner used per printed page may be tied to the resolved mass of toner used and the estimated number of pages printed with the toner cartridge. In one embodiment, the calculating an actual average mass of toner used per printed page comprises dividing the resolved mass of toner used by the estimated number of pages printed with the toner cartridge.

The method may also include the step of outputting a value of one of the resolved mass of toner used, the decrease in the amount of toner from an initial supply of toner, the average mass of toner used per printed page, the actual average mass of toner used per printed page, and the number of pages remaining in the toner cartridge. The outputting may be to a user display. The method may also include the step of storing a value of one of the resolved mass of toner used, the decrease in the amount of toner from an initial supply of toner, the average mass of toner used per printed page, the actual average mass of toner used per printed page, and the number of pages remaining in the toner cartridge in a memory.

In accordance with a third aspect of the invention a toner cartridge for an electrophotographic device is disclosed. The toner cartridge may include a reservoir containing a supply of toner and a sensor to measure the amount of toner in the reservoir. The toner cartridge may also include a processor operably connected to the sensor and capable of calculating an average mass of toner used per printed page using an averaging function; estimating a number of pages printed with the toner cartridge; and calculating an actual average mass of toner used per printed page. In one embodiment, the processor calculates the average mass of toner used per printed page based on a mass of toner used for a current printed page and the decrease in the amount of toner from the initial load of toner. Also, the toner cartridge may include a memory that stores a default value for the average mass of toner used per printed page and the decrease in the amount of toner from the initial load of toner. The toner cartridge may also include a bypass switch capable of bypassing the steps of calculating an average mass of toner used per printed page using an averaging function; estimating a number of pages printed with the toner cartridge; and calculating an actual average mass of toner used per printed page.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE PREFERRED EMBODIMENTS

In the following detailed description of the preferred embodiments, reference is made to the accompanying drawings that form a part hereof, and in which is shown by way of illustrations, specific embodiments in which the invention may be practiced. These embodiments are described in sufficient detail to enable those skilled in the art to practice the invention and like numerals represent like details in the various figures. Also, it is to be understood that other embodiments may be utilized and that process, mechanical and/or other changes may be made without departing from the scope of the present invention. In accordance with the present invention, a method for determining the number of printed pages remaining in a toner cartridge and related toner cartridge and EP device are hereafter described.

Figure 1:
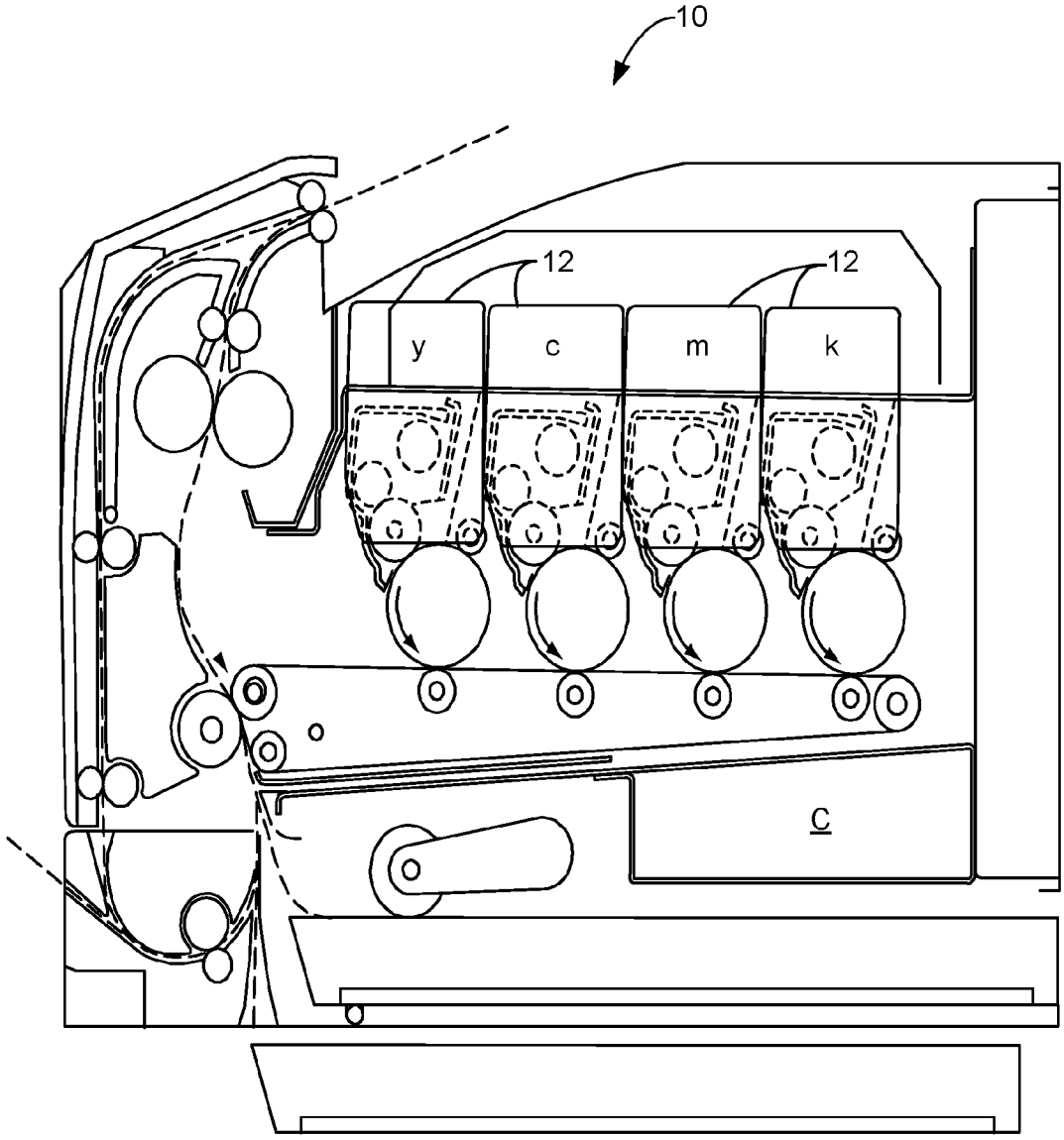
FIG. 1 is a cutaway side view of a representative electrophotographic image forming device of the present invention.
Figure 2A:
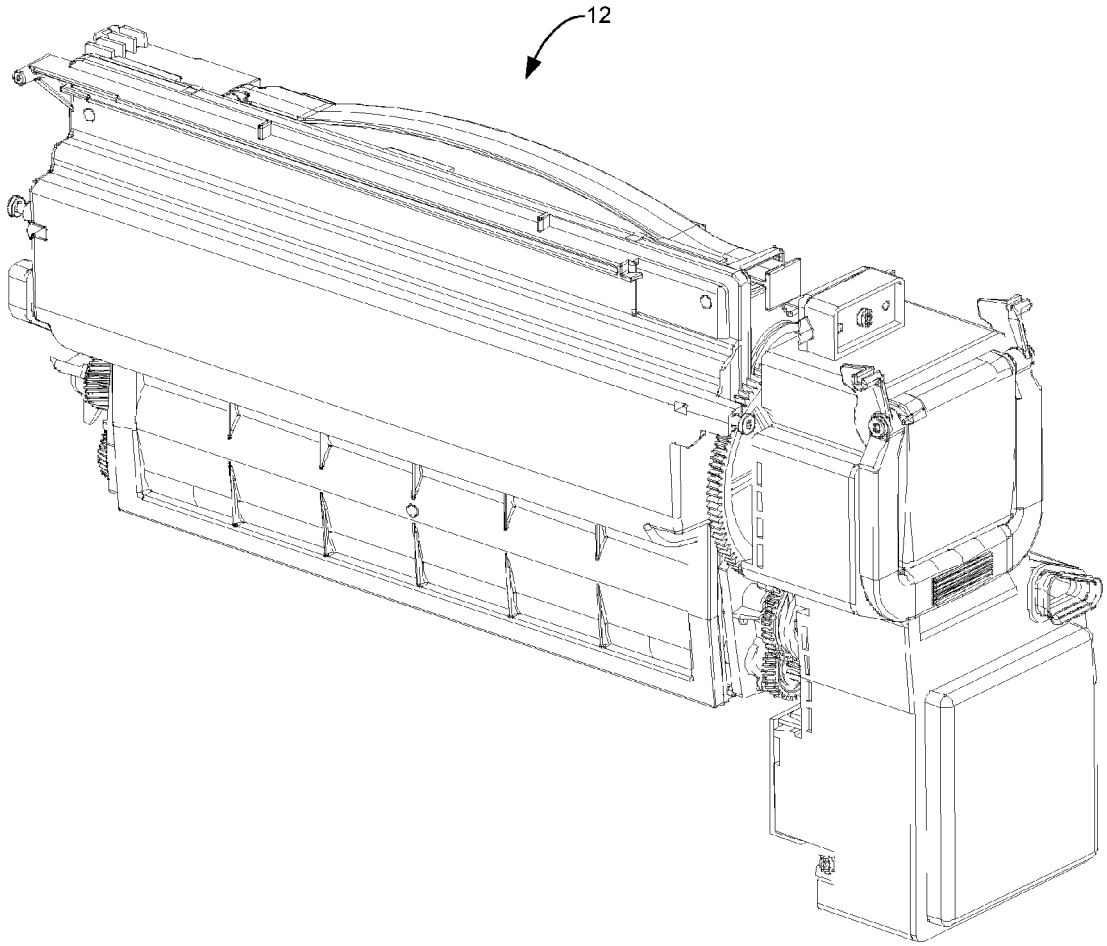
FIG. 2*a* is a perspective view of a representative toner cartridge assembly of the present invention.
Figure 2B:
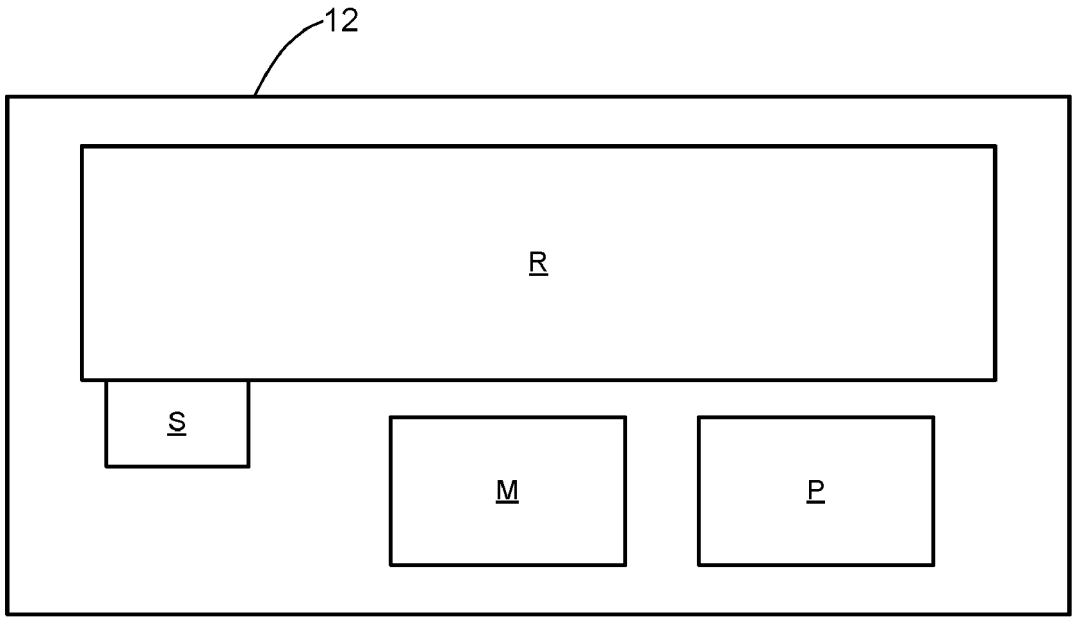
FIG. 2*b* is a schematic representation of the toner cartridge assembly of FIG. 2*a*.

FIG. 1 illustrates a representative electrophotographic image forming device ("EP device"), such as a laser printer 10. As is well-known in the art and shown in FIGS. 2*a* and 2*b*, the EP device generally utilizes one or more removable toner cartridge assemblies 12 to create a high-quality monochrome or color printed page. With specific reference to FIG. 2*b*, each cartridge 12 generally includes a toner reservoir R containing an initial load or fixed amount of toner. Upon depletion of the supply of toner, the cartridge 12 is usually discarded and replaced with another cartridge having a greater toner supply.

In addition to the fixed toner supply, the cartridge 12 may also include one or more sensors S to determine the amount of toner remaining in the toner reservoir. The sensor S may take the form of a mechanical sensor that detects torque required to turn an auger positioned in the reservoir, an optical sensor that uses light to measure the amount of toner, or any other sensor configuration that provides feedback regarding the amount of toner remaining in the reservoir. Additionally, the toner cartridge may include a memory M that stores information about the toner cartridge 12 or otherwise relating to the EP device. The memory M may take any form, such as RAM, ROM, EEPROM, or otherwise, but would preferably be some form of non-volatile memory (NVM) that can store information without being powered. Use of NVM enables information to be transported with the toner cartridge 12 when it becomes removed from the EP device. For instance, if a user desires to move a toner cartridge 12 from one EP device to another, the stored data will remain in the toner cartridge 12 when installed in the second EP device. This memory M may store aspects of one embodiment of the method of the present invention, such as various formulas and values discussed herein. The cartridge 12 may also include a processor P capable of performing or assisting with performing various steps of the method of the present invention. Alternatively, or in addition to the memory M and processor P, a printer controller C (FIG. 1) may store aspects of one embodiment of the method of the present invention and/or perform or assist with performing various steps of the method.

As seen below, the method enables a user to determine the number of printed pages remaining in a removable toner cartridge for an EP device. Instead of relying on the actual number of pages printed using the cartridge, the present method utilizes other factors to determine the number of printed pages remaining on the toner cartridge.

Figure 3A:
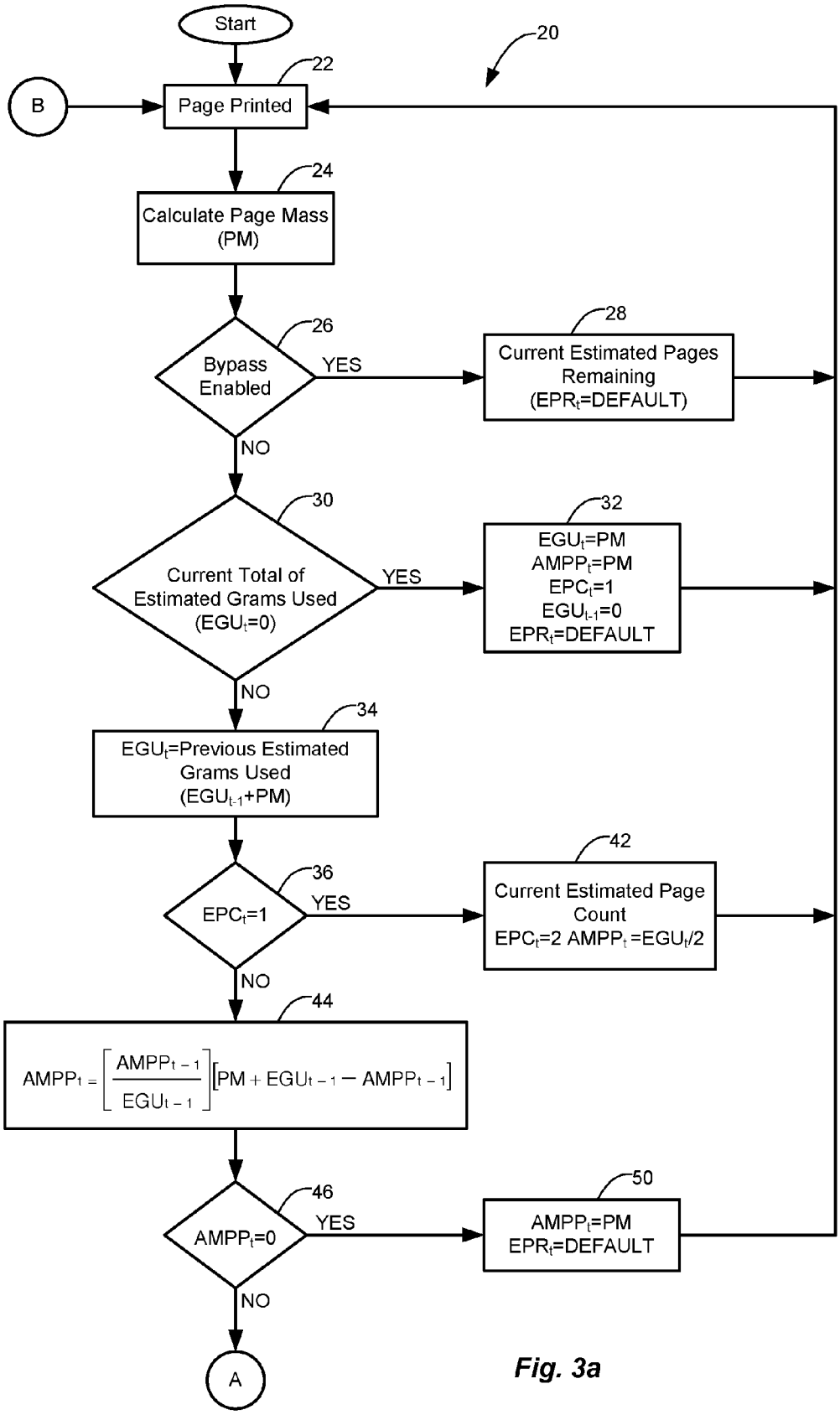
FIGS. 3*a* and 3*b* are flow diagrams of one embodiment of a method for determining the pages remaining in a toner cartridge.
Figure 3B:
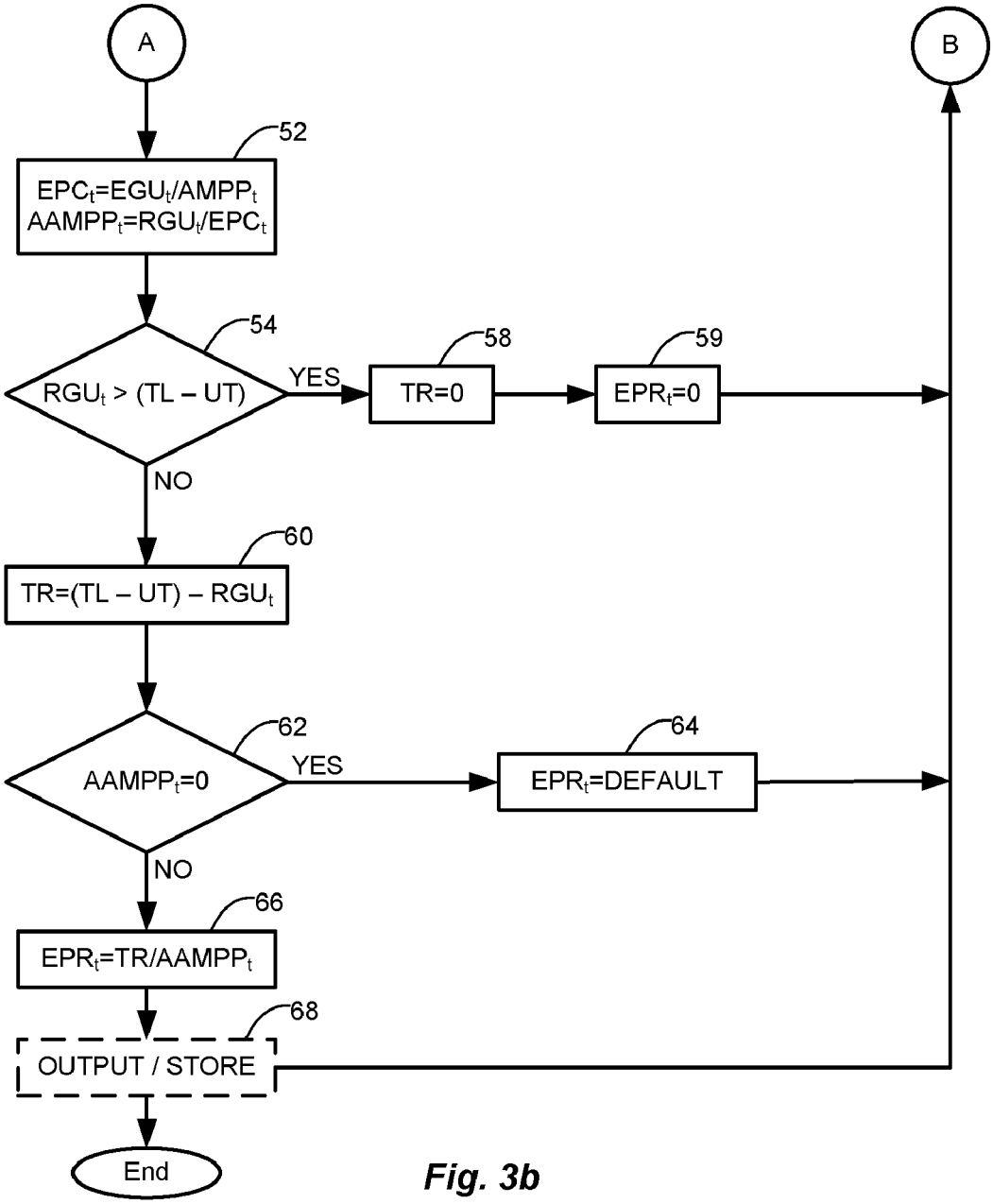

FIGS. 3*a* and 3*b* provide a flow diagram illustrating one embodiment of the present method 20. At step 22, the EP device has completed printing a page. After printing this current page, but before printing another page, step 24 determines or calculates a page mass ("PM") of the mass of toner that was used on the current page. Various methods and/or algorithms may be used to determine the PM. In one embodiment, a pixel or pel count algorithm is used to calculate the PM. Over the life of the toner cartridge 12, the mass per pel ("MPP") will change due to smaller toner particles tending to develop out of the toner cartridge 12 first. This change may be calculated using a linear or quadratic equation. The pel count algorithm includes taking a value for the amount of toner used per million pels from the linear or quadratic equation and multiplying it by the number of pels printed on a printed page. The number of pels printed on a printed page may be determined by hardware on the EP device or otherwise. By multiplying the amount of toner used per million pels by the number of pels printed on a printed page, the PM is determined. [This algorithm may also take into account user resolution settings, mechanical feedback/sensor data relating to the toner cartridge 12 (e.g., from sensor S, FIG. 2*b*), toner that becomes developed on non-imaged parts of the toner cartridge 12 (sometimes referred to as CAD or background toner), and other factors.

After calculation of the PM, a bypass is provided at step 26. The bypass functions as a switch that results in either further steps of the method being conducted or not. The bypass may be programmed into the memory M or otherwise stored on the toner cartridge 12. The manufacturer or other may enable the bypass for any reason. For instance, one may desire to enable the bypass in the event that a toner cartridge becomes programmed with new/different code that does not employ the present method 20. Instead of wholly removing the present method 20 from the memory M, one may wish to disable it, while maintaining it in the memory M for potential future use. In some instances, the PM may be used by other algorithms and/or methods completed by the toner cartridge 12 or the EP device. Accordingly, the calculation of the PM may occur before the bypass at step 26. Alternatively, the bypass step 26 may occur before the calculation of the PM.

If the bypass is activated, the current estimated pages remaining ("EPRt") that the toner cartridge can produce is set to a default supply yield (step 28). This default supply yield may be a constant value representing an estimated average number of pages a cartridge can produce. This value may be programmed into the toner cartridge 12 or otherwise provided by the manufacturer or other. Upon this occurring, the EP device is ready to continue printing and restart the method at step 22.

In the event the bypass is not activated, it is determined at step 30 if a total of estimated grams used by the toner cartridge after the printing of step 22 ("$EGU_t$") equals zero. In other words, at this step, it is determined if any toner was ever used by the toner cartridge. If toner was not used, this indicates that the page printed at step 22 is a first non-blank page on a new or "full" toner cartridge. Accordingly, initial conditions are set at step 32 so that $EGU_t$ is equal to the PM since no toner has previously been used. Also, a current average mass of toner per page ("$AMPP_t$") is set to the PM, an estimated page count ("$EPC_t$") is set to one, and the total of EGU by the toner cartridge prior to the printing of step 22 ("$EGU_{t-1}$") is set to zero. At this step, $EPR_t$ remains at the default supply yield. After setting these initial conditions, the EP device is ready to continue printing and step 22 is restarted. On the other hand, if toner was used during the printing of the last printed page, the $EGU_t$ is a number other than zero and the EGU, is actually calculated at step 34. In one embodiment, this includes adding the PM to $EGU_{t-1}$ to establish $EGU_t$.

After calculating $EGU_t$, step 36 determines if $EPC_{t-1}$ equals 1. If so, this indicates that the page printed at step 22 is a second printed page on a new or "full" toner cartridge. Step 38 sets further initial conditions so that $EPC_t$ is equal to two and $AMPP_t$ is equal to the $EGU_t$ divided by two. After setting these initial conditions, the EP device is again ready to continue printing and step 22 is restarted. However, in the event that $EPC_{t-1}$ does not equal 1, step 44 calculates the $AMPP_t$ for the toner cartridge. In one embodiment, the $AMPP_t$ is calculated using the formula:

$$AMPP_t = \left(\frac{AMPP_{t-1}}{EGU_{t-1}}\right)(PM + EGU_{t-1} - AMPP_{t-1})$$

wherein $AMPP_{t-1}$ is a previous average mass of toner per page for a previously printed page. When utilizing data from a previously printed page (i.e., "t−1"), this data would preferably be from the printed page immediately preceding the printing of the current page at step 22.

Instead of utilizing an actual page-count dependent calculation, this formula uses a weighted running average function to calculate the average toner usage per printed page. This weighted running average function acts as a low-pass filter which "smoothes" rapid changes in the PM input. In other words, this calculation takes into account the amount of toner being used for each individual printed page and can compensate or adapt for wide swings in toner usage.

At step 46, a check is provided to determine if $AMPP_t$ equals zero. This check simply serves as a mathematical safety to prevent division by zero when determining the $EPC_t$, as discussed below. If $AMPP_t$ equals zero, this indicates that no toner (or substantially no toner) has been used. Accordingly, the $AMPP_t$ is set to equal the PM and the $EPR_t$ is set to equal the default toner supply yield (step 50). As previously discussed, this default supply yield may be programmed into the toner cartridge 12 or otherwise provided by the manufacturer or other. Upon setting the $AMPP_t$ and $EPR_t$, the EP device is ready to continue printing at step 22. If $AMPP_t$ does not equal zero, step 52 (FIG. 3*b*) determines the $EPC_t$.

In one embodiment, $EPC_t$ is calculated from the formula:

$$EPC_t = \frac{EGU_t}{AMPP_t}$$

Since many EP devices are able to determine the actual amount of toner remaining in the supply reservoir, this data may be used for refining estimations and/or calculations of the method. For example, this data may be obtained from the sensor S (discussed above) either by independent measurement of the remaining toner or data for otherwise determining the amount of remaining toner. From this determination of the actual amount of toner remaining, the value of the current resolved grams of toner used ("$RGU_t$") may be adjusted, refined, or resolved to the actual grams used. This value of the $RGU_t$ may be treated as the actual amount of toner used. In one embodiment, the $RGU_t$ is calculated by multiplying the PM by a system darkness factor ("SDF") and adding this value to the sum of any previous resolved grams of toner value ("$RGU_{t-1}$") and the value of any CAD toner. The SDF is used to correct any error in the pel counting previously discussed. The SDF is calculated by determining the error between an estimated value of mass of toner remaining in the toner cartridge 12 and the pel count. The $RGU_{t-1}$ may be obtained from a previous calculation of the $RGU_t$, derived from a known formula, or it may be a constant value. Upon calculation of $EPC_t$ and the $RGU_t$, the actual average mass per page ("$AAMPP_t$") may be determined. Accordingly, the $AAMPP_t$ is a separate value from the $AMPP_t$ that takes into account the actual amount of toner remaining in the supply reservoir via the $RGU_t$. In one embodiment, the $AAMPP_t$ is calculated from the formula:

$$AAMPP_t = \frac{RGU_t}{EPC_t}$$

In some situations, the value of the $RGU_t$ may be greater than the usable amount of toner originally held in the supply reservoir R when the cartridge 12 was full. This discrepancy may occur due to sensitivity of the sensor S or other method used for determining the $RGU_t$ value. To avoid this, a check on the $RGU_t$ is employed at step 54. Specifically, the check ascertains if the $RGU_t$ value is greater than a toner load value ("TL") minus an unusable toner value ("UT"). In one embodiment, the TL is a constant value programmed into the memory M of the toner cartridge 12 during manufacture of the cartridge 12 or at another time. This value may equal the total mass of toner deposited into the toner cartridge 12 reservoir R or another constant value deemed pertinent. The UT may also be a constant programmed into the memory M of the toner cartridge 12. The UT value may also be derived from experimental data or otherwise calculated. In one embodiment, the value of the UT relates to the amount of toner that cannot be developed or printed. For instance, a certain amount of toner may adhere to surfaces in the cartridge assembly or otherwise remain trapped in crevices or other structure of the cartridge. Since this toner remains trapped in the cartridge, it cannot be used for printing.

If the $RGU_t$ is greater than the difference between the TL and UT, the toner remaining ("TR") is set to zero at step 58, $EPR_t$ is set to zero at step 59 and the EP device is ready to continue printing at step 22. In this case, the TR is set to zero because the calculated $RGU_t$ is greater than the TR, which is impossible. Alternatively, if the $RGU_t$ is less than the difference between the TL and UT, then step 60 determines the actual TR in the cartridge. In one embodiment, the TR is calculated from the formula:

$$TR=(TL-UT)-RGU_t$$

Upon determining the TR, another check is provided to determine if the $AAMPP_t$ equals zero, step 62. Similar to the check at step 46, this represents a mathematical safety and prevents division by zero when determining the $EPR_t$ using the formula discussed below. If the $AAMPP_t$ equals zero, the $EPR_t$ is set to the default supply yield (step 64). This is because the calculated $AAMPP_t$ indicates that no (or substantially no) toner has been used. As previously discussed, this default supply yield may be programmed into the toner cartridge 12 or otherwise provided by the manufacturer or other. After setting the $EPR_t$, the EP device is ready to continue printing and restart at step 22.

If the $AAMPP_t$ does not equal zero, the actual $EPR_t$ is calculated at step 66 from the formula:

$$EPR_t = \frac{TR}{AAMPP_t}$$

At this point, the $EPR_t$ may be stored for future access and/or further use or displayed for a user (optional step 68). For instance, a software program that interfaces with the EP device and/or cartridge may display the $EPR_t$ on a user's computer screen. This may appear in the form of a graph, gauge, or other graphic for indicating the number of pages remaining. The $EPR_t$ may also be displayed on the EP device itself, such as on a LCD display or other control panel acting as a user interface. In lieu of, or in addition to the $EPR_t$ value, any of the other variables discussed herein may also be displayed for the user.

Any combination of these variables may also be stored in the memory M of the toner cartridge 12 and/or controller C. For example, the memory M may store the $RGU_t$, EGU, $AMPP_t$, EPR, or any other combination of a single variable or multiple variables. This storage allows these variables to be transported with the cartridge when it becomes removed from the EP device. Also, this storage allows another system to access the variables. For instance, a computer and/or network, separate from the EP device and toner cartridge 12, may access certain variables stored in the toner cartridge 12 for additional computations or remote monitoring of the toner cartridge 12.

In summary, the present invention presents a method 20 for determining the number of printed pages remaining in a removable toner cartridge 12. The method does not depend on the actual number of pages printed, but instead takes into account other variables, including the amount of toner used per individual page. The present invention also presents a toner cartridge 12 and EP device capable of storing and performing the method 20.

The foregoing discussion was chosen to provide the best illustration of the principles of the invention and its practical application to thereby enable one of ordinary skill in the art to utilize the invention in various embodiments and with various modifications suited to the particular use contemplated. Any of the determinations or calculations discussed herein may be performed by a user, controller, computer processor, and/or otherwise. Accordingly, these determinations or calculations may be conducted on the toner cartridge, on the printer, or remote from the printer and/or toner cartridge. Also, while one embodiment illustrates the processor P and memory M being separate components on the toner cartridge 12, these may be combined into a single component. Alternatively, only a memory M or processor P may be provided without the other. Although the terms "cartridge assembly" or "toner cartridge assembly" are used throughout this specification, a skilled artisan will appreciate that the method may be used with any supply item of an EP device. All modifications and variations are within the scope of the invention as determined by the appended claims when interpreted in accordance with the breadth to which they are fairly, legally and equitably entitled.

What is claimed:

1. A toner cartridge for an electrophotographic device, comprising:

a reservoir containing a supply of toner;

a sensor to measure the amount of toner in the reservoir; and a processor operably connected to the sensor and capable of calculating an average mass of toner used per printed page using an averaging function; estimating a number of pages printed with the toner cartridge; and calculating an actual average mass of toner used per printed page based on a mass of toner used for a current printed page and a decrease in the amount of toner from the supply of toner.

2. The toner cartridge of claim 1, wherein a memory stores a default value for the average mass of toner used per printed page and the decrease in the amount of toner from an initial load of toner.

3. The toner cartridge of claim 1, further comprising a memory to store at least one value.

4. A toner cartridge for an electrophotographic device, comprising:

a reservoir containing a supply of toner;

a sensor to measure the amount of toner in the reservoir;

a processor operably connected to the sensor and capable of calculating an average mass of toner used per printed page using an averaging function; estimating a number of pages printed with the toner cartridge; and calculating an actual average mass of toner used per printed page; and a bypass switch capable of bypassing the steps of calculating an average mass of toner used per printed page using an averaging function; estimating a number of pages printed with the toner cartridge; and calculating an actual average mass of toner used per printed page.

5. A method for determining a number of pages remaining in toner cartridge having an initial load of toner, comprising: in a processor, estimating an average mass of toner used per printed page for all pages printed with the toner cartridge, the estimating using an averaging function tied to a mass of toner used for a current printed page and a decrease in an amount of toner from the initial load of toner;

estimating a number of total pages printed with the toner cartridge based on the decrease in the amount of toner from the initial load of toner;

calculating an actual average mass of toner used per printed page for all pages printed with the toner cartridge based on the decrease in the amount of toner from the initial load of toner; and determining the number of pages remaining in the toner cartridge based on the actual average mass of toner used per printed page for all pages printed with the toner cartridge.

6. The method of claim 5, further comprising the step of calculating the decrease in the amount of toner from the initial load of toner.

7. The method of claim 6, wherein the calculating a total amount of toner used comprises setting the total amount of toner used to a default value.

8. The method of claim 7, wherein the calculating a total amount of toner used comprises increasing the default value by the mass of toner used for the current printed page.

9. The method of claim 5, further comprising the step of calculating an amount of toner remaining in the toner cartridge.

10. The method of claim 9, wherein the calculating the amount of toner remaining in the toner cartridge comprises measuring the amount of toner remaining in the toner cartridge with a sensor.

11. The method of claim 10, further comprising the step of calculating the decrease in the amount of toner from the initial load of toner.

12. The method of claim 11, further comprising the step of adjusting the decrease in the amount of toner from the initial load of toner based on the measuring the amount of toner remaining in the toner cartridge with a sensor.

13. The method of claim 12, further comprising the step of calculating toner remaining in the toner cartridge based on a default value of printable toner and the decrease in the amount of toner from the initial load of toner.

14. The method of claim 5, further comprising the step of calculating a mass of toner used for the current printed page.

15. The method of claim 14, wherein the determining a mass of toner used for the current printed page comprises calculating the mass of toner used for the current printed page using a pel count algorithm.

16. A method for analyzing a toner cartridge, comprising: in a processor, calculating an average mass of toner used per printed page for all pages printed with the toner cartridge, the calculating using an averaging function;

estimating a number of pages printed with the toner cartridge based on the average mass of toner used and a decrease in an amount of toner from an initial supply of toner;

calculating an actual average mass of toner used per printed page using the estimated number of pages printed; and calculating the number of printed pages remaining in the toner cartridge based on the actual average mass of toner used per printed page.

17. The method of claim 16, wherein the averaging function is tied to a mass of toner used for a current printed page and the decrease in an amount of toner from the initial supply of toner.

18. The method of claim 17, wherein the mass of toner used for the current printed page is calculated using a pel count algorithm.

19. The method of claim 16, wherein the estimating the number of pages printed comprises dividing the decrease in an amount of toner from the initial supply of toner by the calculated average mass of toner used per printed page for all pages printed with the toner cartridge.

20. The method of claim 19, further comprising the step of adjusting the value of the decrease in the amount of toner from the initial load of toner based on a measurement of the amount of toner remaining in the toner cartridge, thereby obtaining a resolved mass of toner used.

21. The method of claim 20, wherein the calculating an actual average mass of toner used per printed page is tied to the resolved mass of toner used and the estimated number of pages printed with the toner cartridge.

22. The method of claim 21, wherein the calculating an actual average mass of toner used per printed page comprises dividing the resolved mass of toner used by the estimated number of pages printed with the toner cartridge.

23. The method of claim 22, further comprising the step of outputting a value of one of the resolved mass of toner used, the decrease in the amount of toner from an initial supply of toner, the average mass of toner used per printed page, the actual average mass of toner used per printed page, and the number of pages remaining in the toner cartridge.

24. The method of claim 23, wherein the outputting is to a user display.

25. The method of claim 24, further comprising the step of storing a value of one of the resolved mass of toner used, the decrease in the amount of toner from an initial supply of toner, the average mass of toner used per printed page, the actual average mass of toner used per printed page, and the number of pages remaining in the toner cartridge in a memory.

* * * * *